United States Patent [19]

Gibson et al.

[11] Patent Number: 4,581,968

[45] Date of Patent: Apr. 15, 1986

[54] SAW CHAIN WITH IMPROVED CUTTING DEPTH CONTROL

[75] Inventors: Duane M. Gibson, Milwaukie; Lewis A. Scott, Lake Oswego; Kent L. Huntington, Molalla; William G. Killen, Newberg, all of Oreg.

[73] Assignee: Omark Industries, Inc., Portland, Oreg.

[21] Appl. No.: 600,005

[22] Filed: Apr. 13, 1984

[51] Int. Cl.[4] ..... B27B 33/14

[52] U.S. Cl. ..... 83/833; 83/834

[58] Field of Search ..... 83/830, 831, 832, 833, 83/834

[56] References Cited

U.S. PATENT DOCUMENTS

| | | | |
|---|---|---|---|
| 3,066,711 | 12/1962 | Winnlert | 83/833 |
| 3,380,496 | 4/1968 | Hill | 83/830 |
| 4,348,927 | 9/1982 | Olmr | 83/834 X |
| 4,353,277 | 10/1982 | Silvon | 83/834 X |
| 4,459,890 | 7/1984 | Dolata et al. | 83/834 |

*Primary Examiner*—James M. Meister
*Assistant Examiner*—John L. Knoble
*Attorney, Agent, or Firm*—Robert L. Harrington

[57] ABSTRACT

A gulletless saw chain having a cutting link with a cutter portion that is configured to be top sharpenable. A depth gauge portion is positioned in close proximity to the cutting edge corner of the cutter portion. The depth gauge is laterally offset to position the outer most edge of the depth gauge at the corner of the cutting edge to thereby control side penetration as well as depth penetration of the cutting edge. A drive link preceding the cutting link includes a guide portion with an inclined leading edge that corresponds with the leading edge of the depth gauge. A shallow V shaped opening is formed between the depth gauge and drive link guide portion to assist the cutting link in tracking in the kerf.

18 Claims, 8 Drawing Figures

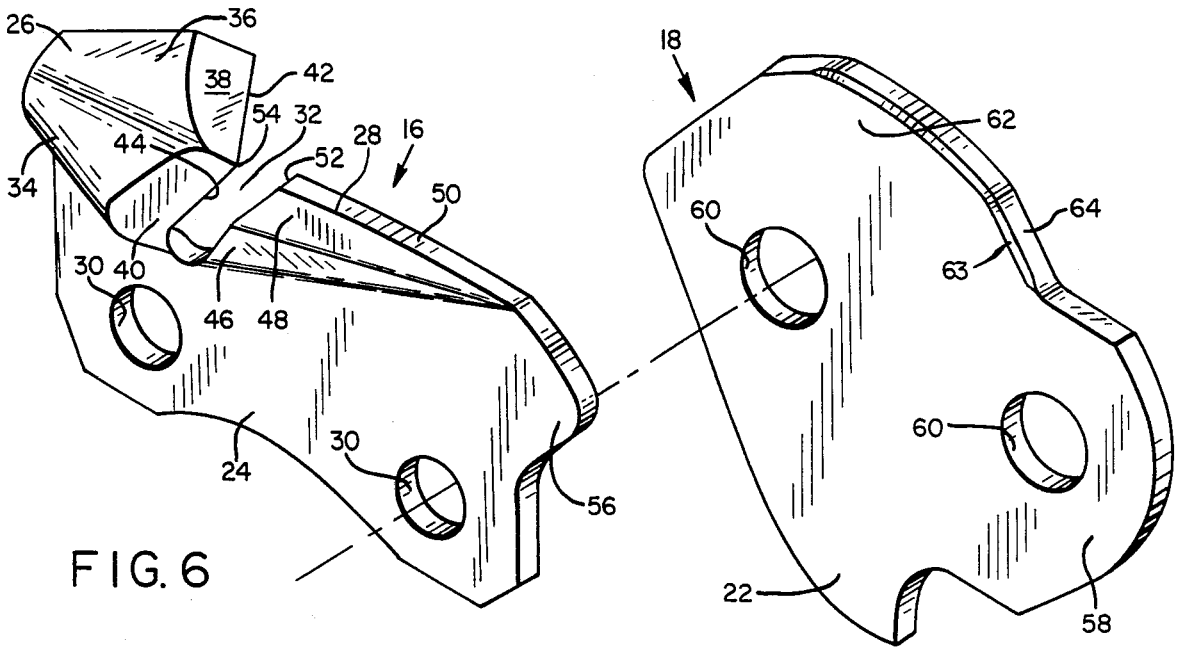
FIG. 6
FIG. 7
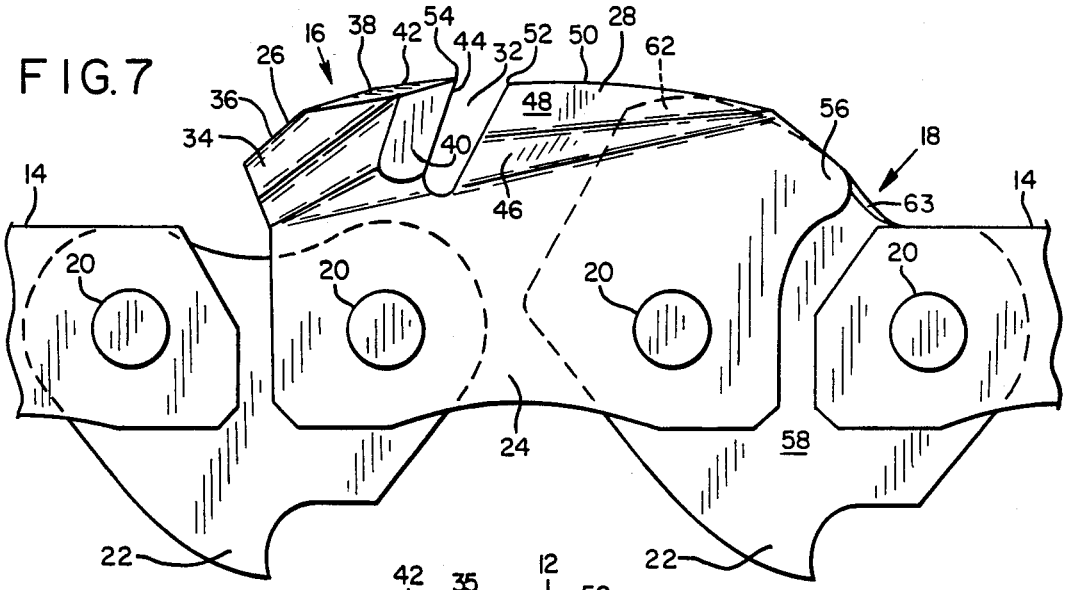
FIG. 8
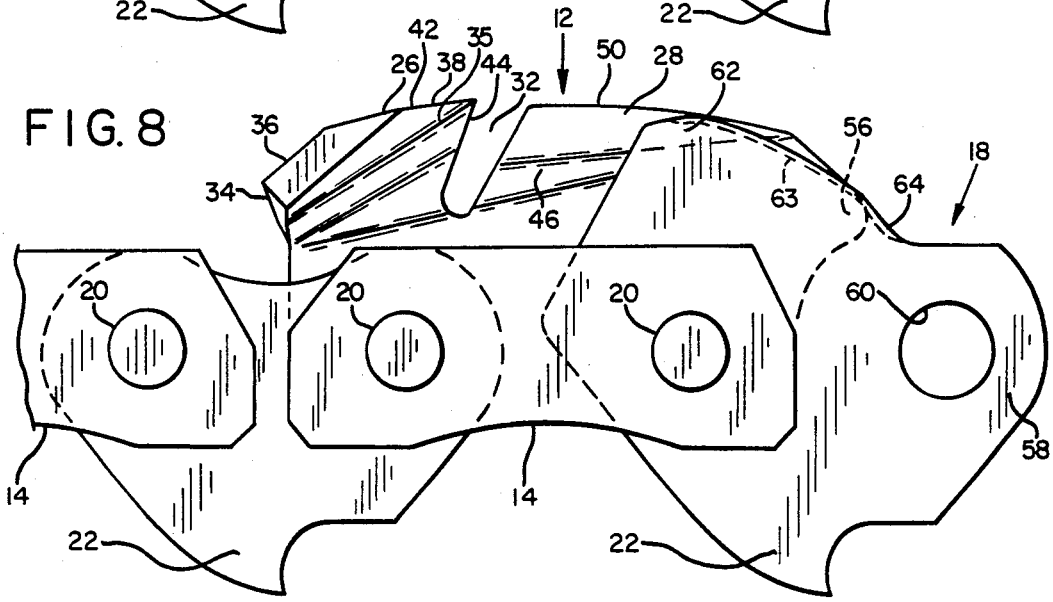

SAW CHAIN WITH IMPROVED CUTTING DEPTH CONTROL

FIELD OF INVENTION

This invention relates to saw chain (or cutting chains as they are often referred to) having control features that control the penetration of the cutting edges of the saw chain into the material being cut.

BACKGROUND OF INVENTION

In order to fully understand this invention, the reader should have an appreciation of the action of a saw chain that is cutting through a tree or log. A saw chain is made up of a large number of individual links (100 plus) that range from about a half inch in length to an inch in length. The links are pivotally connected together, mounted to the periphery of an ovally shaped guide bar, driven around the periphery of the bar at speeds in the range of 60 miles per hour and then forced into a log where it cuts into and through knots, twists, knurls and the like common in trees and logs.

Regardless of how tight the chain is mounted on the guide bar, the cutting links within the chain link sequence are jerked and twisted, in and out of the kerf and from side to side (as permitted by the pivotal connections) as the cutters engage and cut through the wood and its variety of irregularities. During this process of cutting, any time that a cutting edge becomes oriented so that it gets buried too deep into the wood, the forward momentum of the chain is brought to an abrupt stop. This can result in "kickback", a term used to describe a rearward thrusting of the guide bar and saw chain toward the operator.

The incidence of kickback has been greatly reduced by dealing with the in and out pivotal action of the cutter. A variety of depth gauge and bumper link configurations have been provided to effectively prevent the cutting edge from diving too deep into the kerf. However, kickback has not been eliminated because such configurations have not considered the side plate cutting edge.

The conventional cutter is L-shaped with the primary cutting edge being on the top plate of the cutter (the lateral leg of the L in an inverted position). It also includes a secondary cutting edge that wraps around the corner of the L and at least partially down the side plate of the cutter. This secondary cutting edge functions to cut the wood fibers along the side walls of the kerf. As mentioned, the saw chain is jerked and twisted sideways as well as in and out of the kerf bottom and should this secondary cutting edge become oriented so as to dive or dig into the side wall of the kerf, kickback can occur. It is the prevention of this sidewall digging in condition to which the present invention is directed.

L-shaped cutters (sometimes referred to as hooded cutters) can be classified in two broad categories based on the manner by which the cutting edges are sharpened. Conventional cutters are sharpened by grinding the surfaces forming the underside or inside surfaces behind the cutting edges. A file is inserted into the space between the depth gauge and cutter (the gullet of the cutting link) and angled under the corner formed by the top and side plates of the cutter. Top sharpening cutters (the secondary category) are configured so as to be sharpened by simply grinding the outside surfaces behind the cutting edges provided on the top and side plates.

Top sharpening saw chain is available as a convenience chain for the reason that its top sharpening capability allows it to be "automatically" sharpened. It is also recognized as being less protectable against kickback as compared to conventional chain. This is largely due to the configuration of the cutter that allows top sharpening. This configuration creates a cutting edge angle that is "hungry" or "highly aggressive" which, increases the tendency of the cutter to dig in and kick back. Accordingly, improvements to reduce kickback have heretofore been initially developed for conventional saw chain. Features that were proven effective for conventional saw chain were then applied to top sharpening saw chain with proportionate reductions in kickback.

In spite of numerous major improvements, kickback has not been eliminated because of the failure to solve the digging in problem of the secondary cutting edge. A depth gauge that is positioned to the side of the cutter for controlling side cutting penetration (an offset depth gauge) has little or no effect on prior cutting link designs because of the spacing that is necessitated by the gullet. Conventional cutting chain requires this spacing in order to provide for the sharpening implement e.g. a file.

A gullet spacing has also been heretofore required for top sharpening chain in order for it to be automatically sharpened (previously the only justification for its existence). Concepts of automatic sharpening dictate that the depth gauge be ground simultaneously with the cutting edge being sharpened which is achieved by spacing the depth gauge forward of the cutting link's center a distance greater than the cutting edge is rearward of that center. These spacings create a gullet that is even greater than that required for conventional cutting links.

BRIEF DESCRIPTION OF INVENTION

The present invention has successfully minimized the problem of kickback due to side plate penetration. It has been achieved by departing from the approach of directing the developmental efforts to conventional saw chain design. A top sharpening saw chain does not require a gullet if the prior concept of automatic sharpening is abandoned. Moving the depth gauge rearwardly to a position immediately adjacent the cutting edge and outwardly toward the corner formed by the top and side cutting edges effectively limits the ability of these cutting edges to dive inwardly or sidewardly, and kickback is substantially reduced. This cutting link design does not lend itself to the above described "automatic sharpening" (i.e. simultaneous sharpening of the cutter and depth gauge) but it is at least as easy to sharpen as conventional saw chain.

Other features of the preferred embodiment of the invention include the provision of a depth gauge side control landing with relief angles to effectively resist digging in while avoiding undue frictional drag. It has also been found that it is desirable to provide "tracking" for the cutting link. Such tracking improves lateral stability and further reduces kickback. Providing a drive link having a guide portion is beneficial to this "tracking" function and as combined with the improved depth gauge disclosed herein, is a further feature of this invention.

DETAILED DESCRIPTION AND DRAWINGS

The invention will be further appreciated by reference to the following detailed description and drawings wherein:

FIG. 6 is a perspective view of an unassembled cutting link and center drive link of the chain sequence of FIG. 1;

FIG. 7 is an enlarged side view of an assembled right hand cutting link and a pair of center drive links of the saw chain of FIG. 1; and FIG. 8 is an enlarged side view of a left hand cutting link and a pair of center drive links of the saw chain of FIG. 1.

Figure 2:
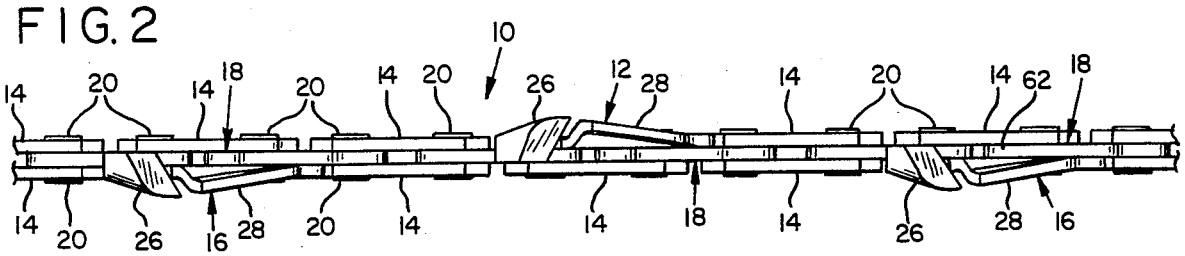
FIG. 2 is a top view of the length of saw chain shown in FIG. 1.
Figure 1:
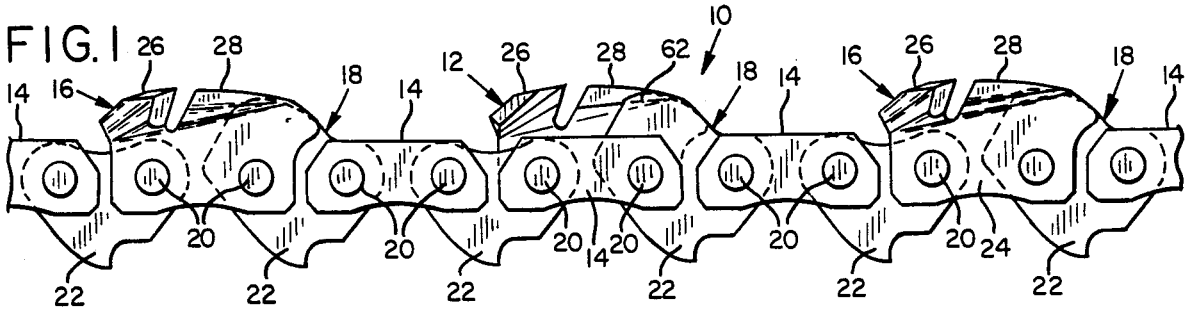
FIG. 1 is a side view of a length of saw chain in accordance with the present invention.

Referring to FIGS. 1 and 2 of the drawings, a length of saw chain 10 includes side link pairs interconnected by center drive links. A left hand cutting link 12 forms a side link on one side of the saw chain opposite a tie strap side link 14, and in a similar manner but reversed therefrom, a right hand cutting link 16 forms a side link opposite a tie strap side link 14. Additionally, pairs of side link tie straps 14 provide spacing between the cutting link pairs as illustrated. The pairs of side links are interconnected by center drive links 18 having drive tangs 22, that are pivotally connected to the side links by rivets 20. This sequence of side links and drive links is standard in the industry as is the concept of driving the chain around the guide bar. Therefore, explanation of the drive system will not be provided except to point out that as mounted on the guide bar, the drive tangs 22 project inwardly relative to the guide bar and the cutters on the cutting links 12 and 16 project outwardly from the guide bar. Hereafter, the terms inwardly and outwardly having reference to the configurations of the saw chain links will be consistent with this understanding.

Figure 4:
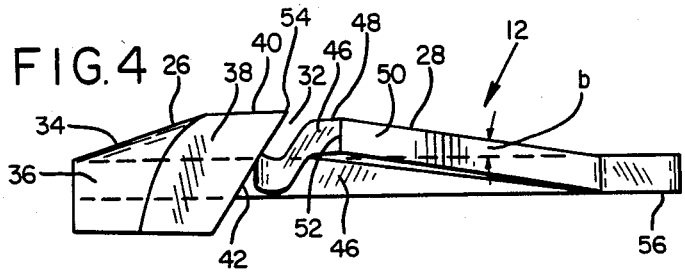
FIG. 4 is a top view of the cutting link of FIG. 3.
Figure 3:
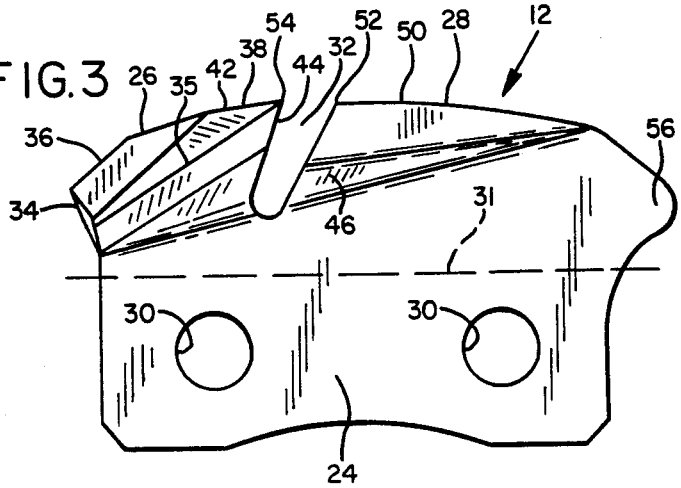
FIG. 3 is an enlarged side view of one of the cutting links of the saw chain of FIGS. 1 and 2.
Figure 5:
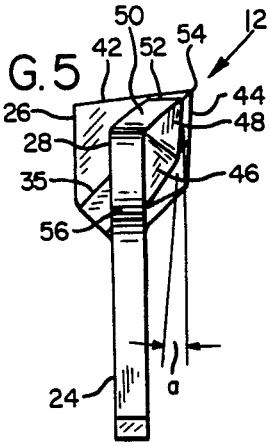
FIG. 5 is a front view of the cutting link of FIG. 4.

Referring now to FIGS. 3, 4, and 5, a left hand saw chain cutting link 12 is illustrated. However, it will be understood that the right hand cutting link 16 is simply a mirror image thereof and similar reference numbers are hereafter used to indicate their corresponding mirror image parts. Cutting link 12 includes a body portion 24 (with rivet hole openings 30) that provides the base for a cutter portion 26 and a depth gauge 28. It will be understood that the cutting link 12, including body portion 24, cutter 26, and length gauge 28 are formed out of a single strip of metal. The separation between the body portion and the cutter and depth gauge portions are not precise but are generally considered the portions above the configuration of a side link 14 e.g. above the imaginary link 31 provide on FIG. 3.

A limited separation forming a narrow slit or gap 32 is provided between the cutter and depth gauge to facilitate the metal forming operation for forming the cutter and depth gauge. Whereas it is desirable to minimize this gap 32, it is possible to mold the cutting link and eliminate the gap altogether. However, practical experience teaches that molding these cutting links is far more expensive than the metal forming operation in current use and thus the minimum gap opening for the forming operation is preferred.

As will be apparent by viewing the drawings, the cutter or cutter portion 26 is formed from an outwardly or upwardly (as viewed in FIG. 3) projected appendage that is first twisted laterally about a vertical axis from back to front to form the side plate 34 and then bent back over the body portion and along an inclined line (see line 35) to form an inclined, back to front, top plate 36. The top plate is ground off generally horizontally as oriented in the drawing (referred to herein as flat top grinding) to produce a top cutting edge face 38, and the side plate is ground off generally vertically (referred to herein as flat side grinding) to produce a side cutting edge face 40. The intersection of the faces 38 and 40 with the inside surface of the top and side plates produces the cutting edges 42 and 44 respectively. It is important to appreciate that, as the cutting edges 42 and 44 become dull, sharpening simply requires grinding off minute portions of the cutting edge faces 38 and 40. Such sharpening does not require that a file enter the gap 32 between the cutter and depth gauge.

The depth gauge 28 is also formed of an upwardly projected appendage that is laterally twisted from front to back toward the cutting edge corner 54. An upper portion of the appendage is held in a generally vertical plane to produce a flat outside surface 48 (hereafter sometimes referred as a "landing surface") that is generally parallel to the plane of the cutter body. The surface 48 is preferably slightly angled both inwardly (angle "a" in FIG. 5) and forwardly (angle "b" in FIG. 4) toward the body portion to provide relief for reducing frictional drag against the side wall of the kerf being cut. The upper edge 50 of the depth gauge starts with its corner 52 in close proximity to the cutting edge corner 54 and declines gradually (essentially in a straight line but slightly curved) to a nose portion 56 (that portion on the front of the depth gauge that is generally forwardly of the body portion 24).

The gap 32 is provided with a minimum opening and is generally V shaped. The back leg of the V is provided by the extension of cutting edge 44 and this cutting edge in combination with the V shape (being narrower at the inner end than at the outer end) effectively prevents wood chips from packing or clogging the gap 32. Should wood chips become packed into the gap, the cutting action would be detrimentally effected.

SPECIFIC EMBODIMENT

A cutting link of the present invention which has been produced and successfully tested is a three eighth inch pitch cutting link (distance between centers of rivet holes) having an overall length of about three fourths inch. The cutter has a length of about one-fourth inch and the depth gauge a length of about one-half inch (greater than half the cutting link length). The cutter and depth gauge are separated by a gap of less than one-sixteenth inch. The flat outside surface 48 (the landing area) has an angle "a" (from a line parallel with the plane of the body portion as seen in FIG. 5) of four degrees. It has been determined that this angle is preferably within a range of one degree to six degrees. The corner 52 of the depth gauge is inset laterally from the corner 54 of the cutting edge a distance of about 0.0075 inches (it has been determined that this spacing is preferably within a range of 0 to 0.015 inches) and inset vertically a distance of 0.005 to 0.035 inch. As will be noted in FIG. 5, angle "a" of surface 48 produces an outer profile that is substantially parallel to the profile of side cutting edge 44.

Upper edge 50 of the depth gauge may be be curved or flat but the incline is gradual so as to cam the material being cut over the depth gauge and into the cutting edge. The length of the depth gauge is important for obtaining that gradual incline and the forwardly projected nose portion 56 with its further, although sharper, incline also contributes to this feature as the gradual incline would otherwise produce an unacceptable vertical front edge.

CENTER DRIVE LINK

Reference is now made to FIGS. 6 through 8. All of the center drive links 18 includes a drive tang 22 and a body portion 58 (with rivet hole openings 60). Certain of these drive links (those immediately preceeding the cutting link) have a bumper or guide portion 62. The guide portion 62 has an inclined leading edge 64 that overlaps with and generally matches the incline of the leading edge of the depth gauge 28 (including the leading edge of the nose portion 56 and a portion of the edge 50). With the cutting link and drive link assembled together as shown in FIGS. 7 and 8, these leading edges, as viewed from the side, are substantially in alignment. The advantage of an inclined depth gauge and mating inclined guide portion has been well proven. As the material being cut is engaged by these guide portions, the chain is cammed into the proper relationship relative to the material being cut to restrict the amount of vertical bite that the cutting edge 42 can take.

The guide portion on the drive link in combination with the inclined depth gauge on the cutting link of the present invention has a further beneficial effect. It is important to establish a track for the saw chain and to hold the chain in the track or lateral stability. If the chain has a tendency to wander from side to side i.e. to skate, the result is that the cutting action will be very rough and possibly dangerous to the operator. It is believed that the guide portion of the drive link in combination with the offset depth gauge, enhances lateral stability. Reference is particularly made to FIG. 2 wherein the guide portion 62 and depth gauge portion 28 are close together but separated at the leading edge and gradually further separate toward the rear to form a shallow V opening between them. These kerf engaging protrusions form a ridge in the kerf that urges "tracking" of the cutting link in the kerf. A modification that further assists in this "tracking" function is the provision of a bevel 63 on the upper inside edge of the guide portion of the center link which further separates the two guide portions to increase the width of the ridge.

SUMMARIZATION

The present invention is believed to dramatically depart from the teachings of the prior art. No one heretofore appreciated the contribution of the side cutting edge to kickback or that such could be greatly relieved by locating the depth gauge in close proximity to the side cutting edge. Even if such were appreciated, the teachings of the art would dictate that safety requires conventional cutter design; conventional cutter design dictates the need for a gullet to allow sharpening; and the gullet dictates that a depth gauge be spaced from the cutting edge a distance that prevents the depth gauge from effectively controlling digging in of the side cutting edge.

It is pointed out that the top cutting edge can be controlled quite effectively with the depth gauge spaced from it by the distance of the gullet. This is due to the much greater stability that is provided by the guide bar and the inwardly directed cutting pressure. Side stability is more difficult to achieve and accordingly, the spacing of the conventional gullet renders the depth gauge substantially ineffective for controlling side cutting edge penetration. In spite of the existence of prior top sharpening chain, such would hardly be pursued as an answer to kickback. It is well known that the conventional configuration necessary to produce top sharpening capability also renders the chain more aggressive. Still further, the major objective of the top sharpening chain is automatic sharpening which dictates an even greater spacing between the cutting edge and depth gauge then is required for conventional sharpening.

It is the configuration of the offset depth gauge in close proximity with the side cutting edge, and a landing surface or flat upper surface sufficient to resist side digging in that is believed to control a substantial factor in kickback, i.e. side cutting edge penetration. This close proximity dictates the elimination of a conventional gullet which is replaced with a separating slit or gap having a width no greater than about one-sixteenth inch for a three-eights pitch saw chain i.e. a gap that is less than 20 percent of the pitch of the cutting link.

Whereas those skilled in the art will likely conceive of modifications to the specific embodiment disclosed herein, these modifications are encompassed by the invention as generally explained above and as defined by the claims appended hereto.

We claim:

1. A cutting link for saw chain comprising; a body portion having an inner edge adapted for engaging a guide bar, a cutter portion protruding outwardly from the body portion and positioned rearwardly on the body portion, and a depth gauge projected outwardly from the body portion forwardly of the cutter portion and in close proximity thereto, said cutter portion having a side plate laterally and outwardly angled from the body portion and a top plate extending from the side plate back over the body portion, said side plate and top plate having leading sharpened edges forming cutting edges and the juncture of these edges forming a cutting edge corner that is, relative to the plane of the body portion, the furthermost point of the cutting link both laterally and outwardly, and said depth gauge portion extending from the front of the body portion rearwardly toward the cutter portion and being laterally angled from the front to the back in the direction of the cutting edge corner and terminating with an outer corner in close proximity to the cutting edge corner being spaced therefrom a distance no greater than about 20% of the cutting link pitch, to thereby effectively eliminate the sharpening-enabling gullet spacing between the cutting edge corner and depth gauge.

2. A cutting link as defined in claim 1 wherein the forward spacing of the depth gauge from the cutting edge is no greater than one-sixteenth of an inch.

3. A cutting link as defined in claim 1 wherein the depth gauge includes a side landing surface with a rearward point of termination in close proximity to the cutting edge corner, said landing surface extending at limited relief angles inwardly and forwardly of the point of termination whereby the landing is generally parallel with the plane of the body portion so as to provide resistance to the side cutting edge digging into the side wall of a kerf being cut.

4. A cutting link as defined in claim 3 wherein the landing surface is no less than about 0.030 inch in length.

5. A cutting chain as defined in claim 1 wherein the depth gauge length is greater than half the length of the cutting link.

6. A cutting chain as defined in claim 5 wherein the depth gauge includes a nose portion and an upper edge that is inclined gradually from the nose portion to the rearward most point proximate the cutting edge.

7. A saw chain as defined in claim 1 wherein the gap is V shaped with a small inner width diverging outwardly to prevent chips from clogging in the gap.

8. A cutting chain as defined in claim 3 wherein the depth gauge portion is offset from the body portion by a lateral twisting of the depth gauge from front to back to produce a curved transition portion and the upper landing portion.

9. A cutting chain as defined in claim 1 wherein the cutter portion is configured to provide for sharpening of the cutting edges by a flat top grinding of the top plate and a flat side grinding of the side plate.

10. A cutting chain as defined in claim 9 wherein the cutter portion is produced by a twisting of the side plate portion laterally from back to front and a folding of the top plate portion back over the body portion on an incline fold line whereby flat top grinding of the top plate produces a cutting edge top face that intersects with the under side of the top plate to produce the top plate cutting edge, and a flat side grinding of the side plate produces a cutting edge side face that intersects with the inside of the side plate to produce the side plate cutting edge.

11. A cutting link as defined in claim 1 wherein the pitch of the cutting link is no greater than about three eighth inch.

12. A saw chain as defined in claim 1 wherein the vertical setting of the depth gauge relative to the cutting edge corner is within the range of 0.005 inches to 0.035 inch.

13. A saw chain as defined in claim 13 wherein the lateral setting of the depth gauge relative to the cutting edge corner is within the range of 0 to 0.015 inch.

14. A saw chain as defined in claim 13 wherein the lateral setting of the depth gauge is about 0.0075 inch.

15. A cutting chain as defined in claim 9 wherein a V shaped gap is formed between the cutter portion and depth gauge to allow for a metal forming operation, and wherein the rearward leg of the V shape is provided by the side plate cutting edge to prevent chips from clogging in the gap.

16. A saw chain including side links and center links wherein certain of the side links are cutting links and the center links are drive links, said saw chain comprising; a gulletless cutting link including a body portion having an inner edge adapted for engaging a guide bar, a cutter portion protruding outwardly from the body portion and positioned rearwardly on the body portion, and a depth gauge portion projected outwardly from the body portion forwardly of the cutter portion and in close proximity thereto, said cutter portion having a side plate laterally angled from the body portion and a top plate extending from the side plate back over the body portion, said side plate and top plate having leading sharpened edges forming cutting edges, and the juncture of these edges forming a cutting edge corner that is, relative to the plane of the body portion, the furthermost point of the cutting link both laterally and outwardly, and said depth gauge portion extending rearwardly from the front of the body portion toward the cutter portion and being laterally angled from the front to the back in the direction of the cutting edge corner and terminating with an outer corner in close proximity to the cutting edge corner being spaced therefrom a distance no greater than about 20% of the cutting link pitch, to thereby effectively eliminate the sharpening-enabling gullet spacing between the cutting edge corner and depth gauge; and a center line having a body portion and an outwardly directed guide portion positioned rewardly on the body portion, said guide portion having a rearwardly inclined outer edge, said center link pivotally connected to the cutting link forward of the cutting link and said inclined leading edge of the guide portion in substantial alignment in side view with the inclined edge of the depth gauge.

17. A saw chain as defined in claim 16 wherein the aligned portions of the inclined edges of the guide portion of the center link and the depth gauge of the cutting link are close together at the front and spread apart toward the rear to form a shallow V shape, said V shape generating a track in the material being cut to reduce skating.

18. A saw chain as defined in claim 17 wherein the inclined edge of the guide portion adjacent the depth gauge is beveled to produce a penetrating edge to enhance the tracking function thereof.

* * * * *